US006062228A

United States Patent [19]

Loercks et al.

[11] Patent Number: 6,062,228

[45] Date of Patent: May 16, 2000

[54] BIODEGRADABLE FILTER MATERIAL AND METHOD FOR ITS MANUFACTURE

[75] Inventors: Juergen Loercks, Rees; Harald Schmidt, Emmerich, both of Germany

[73] Assignee: Biotec Biologische Natuverpackungen GmbH & Co., KG, Emmerich, Germany

[21] Appl. No.: 09/043,993

[22] PCT Filed: Sep. 27, 1996

[86] PCT No.: PCT/EP96/04234

§ 371 Date: Mar. 30, 1998

§ 102(e) Date: Mar. 30, 1998

[87] PCT Pub. No.: WO97/12528

PCT Pub. Date: Apr. 10, 1997

[30] Foreign Application Priority Data

Sep. 29, 1995 [DE] Germany ..... 195 36 505

[51] Int. Cl.[7] ..... A24B 15/28; A24D 3/06

[52] U.S. Cl. ..... 131/332; 131/340; 131/345; 264/DIG. 48; 264/45.9; 264/46.1; 264/148; 264/176.1; 264/282; 264/204; 493/42; 493/43; 493/45; 493/46; 493/50

[58] Field of Search ..... 131/88, 331, 332, 131/340, 345, 361; 264/DIG. 48, 45.9, 46.1, 148, 176.1, 177.13, 282, 204, 555, 563; 493/39, 41, 42, 43, 45, 46, 50

[56] References Cited

U.S. PATENT DOCUMENTS

| | | |
|---|---|---|
| 4,863,655 | 9/1989 | Lacourse et al. . |
| 5,153,037 | 10/1992 | Altieri . |
| 5,396,909 | 3/1995 | Gentry et al. . |
| 5,402,802 | 4/1995 | Kakiuchi et al. . |
| 5,497,793 | 3/1996 | Kubica . |

FOREIGN PATENT DOCUMENTS

| | | |
|---|---|---|
| 0285811 | 10/1988 | European Pat. Off. . |
| 0539191 | 4/1993 | European Pat. Off. . |
| 0541050 | 5/1993 | European Pat. Off. . |
| 0542155 | 5/1993 | European Pat. Off. . |
| 0597478 | 5/1994 | European Pat. Off. . |
| 0614620 | 9/1994 | European Pat. Off. . |
| 614620 | 9/1994 | European Pat. Off. . |
| 0632968 | 1/1995 | European Pat. Off. . |
| 0632969 | 1/1995 | European Pat. Off. . |
| 0632970 | 1/1995 | European Pat. Off. . |
| 0634113 | 1/1995 | European Pat. Off. . |
| 634113 | 1/1995 | European Pat. Off. . |
| 0641525 | 3/1995 | European Pat. Off. . |
| 0672772 | 9/1995 | European Pat. Off. . |
| 1079521 | 4/1960 | Germany . |
| 4013304 | 10/1991 | Germany . |
| 4013293 | 11/1991 | Germany . |
| 4109603 | 9/1992 | Germany . |
| 4116404 | 11/1992 | Germany . |

(List continued on next page.)

OTHER PUBLICATIONS

M. Korn: "Holz und Cellulose haltige Materialien". Nachwachsende und bioabbaubare Materialien, Verlag Roman Kovar, Muenchen, p. 122. No Date.

*Primary Examiner*—Stanley S. Silverman
*Assistant Examiner*—Michael P. Colaianni
*Attorney, Agent, or Firm*—Workman, Nydegger & Seeley

[57] ABSTRACT

There is provided a biodegradable filter tow or filter material from renewable raw materials for the use as a tobacco smoke filter element of cigarettes, cigars or pipes as well as a method for preparing it, wherein fibers, films or foams prepared in an extrusion method from biopolymers based on thermoplastic starch or its polymer compositions are processed to the filter tow or filter material according to the present invention.

The advantages of this invention reside in the use of mainly renewable raw materials, a fast and complete biodegradability of the natural biopolymer filter material, a pollutant-reducing flavor-increasing filtering effect and an economically favorable preparation method.

19 Claims, 4 Drawing Sheets

FOREIGN PATENT DOCUMENTS

| | | |
|---|---|---|
| 4325352 | 9/1994 | Germany . |
| 4322965 | 10/1994 | Germany . |
| 4322967 | 10/1994 | Germany . |
| 4322966 | 1/1995 | Germany . |
| 5377812 | 1/1995 | Japan . |
| 5392586 | 2/1995 | Japan . |
| 2205102 | 11/1988 | United Kingdom . |
| 90/05161 | 5/1990 | WIPO . |
| 92/15209 | 9/1992 | WIPO . |
| 93/02070 | 4/1993 | WIPO . |
| 93/07771 | 4/1993 | WIPO . |

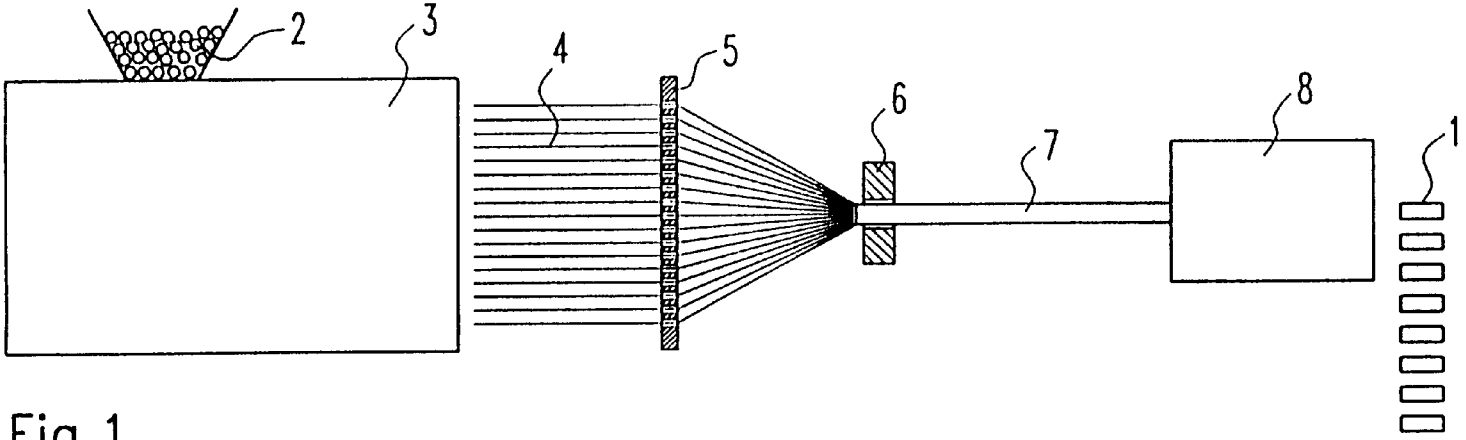
Fig.1
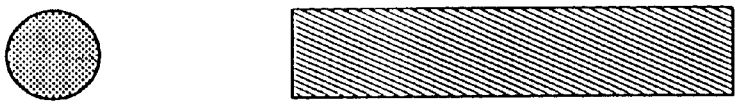
Fig.1b
Fig.1a
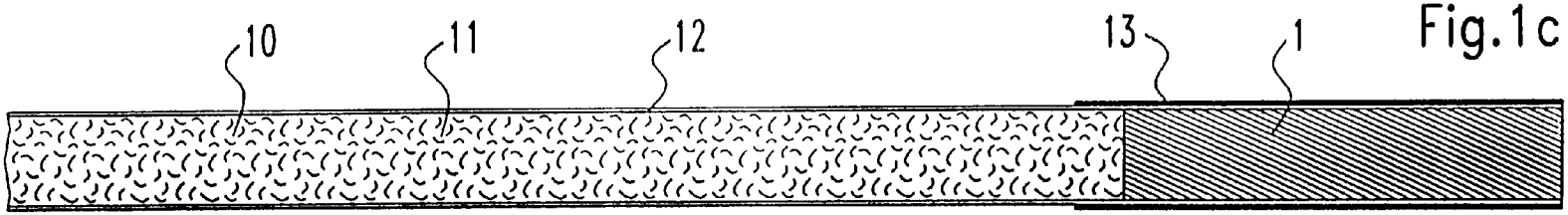
Fig.1c

BIODEGRADABLE FILTER MATERIAL AND METHOD FOR ITS MANUFACTURE

BACKGROUND OF THE INVENTION

The invention relates to a method for preparing a biodegradable filter material from renewable raw materials for the use as tobacco smoke filter elements of cigarettes, cigars or pines.

Smoker articles such as for example cigarettes have a cylindrical shape in which the shredded smokable tobacco material is surrounded by a paper wrap. The majority of said cigarettes have at the one end a filter which is connected to the cigarette by means of a band. Filter elements and cigarette filters are extensively described in the literature as filter tows. For the preparation of cigarette filters usually a fiber material made of the materials cellulose-2,5-acetate or polypropylene is used. The use of paper or cotton wool is known either. According to a known method a cellulose acetate fiber material is prepared in most cases by the nozzle (spinneret) spinning process. From the cellulose acetate filaments and/or cellulose acetate spun fibers which are curled or crushed in a compression chamber, the filter tows are at first prepared as filter rods by stretching the curled ribbon, increasing it in volume and bringing it in the desired dimension in a formatting device and wrapping it with paper. The cellulose-2,5-acetate raw materials are normally compounded with the softener clycerin acetate which is contained in the tobacco smoke and may cause problems. With respect to the definition and description of a filter tow and tobacco filter element it is referred to DE-A-41 09 603 and DE-A-10 79 521. Methods for the preparation of filter tows and filter cigarettes are explained i.a. in the documents U.S. Pat. No. 5,402,802, DE-A-41 09 603, JP-A-5-377 812, EP-A-0 285 811, WO 93/02070, JP-A-5-392 586, WO 92/15209 and EP-A-0 641 525. Moreover, a plurality of suggestions for the preparation and use of biodegradable cigarette filters, which are prepared on the basis of cellulose ester and/or polyhydroxy butyric acid (PHB) or a copolymer of polyhydroxy butyric acid/polyhydroxy valeric acid (PHB/PHV), have been published, e.g. DE-A-43 22 965, DE-A-43 22 966, DE-A-43 22 967. Complex solutions are know for the problem of achieving an accelerated biodegradability of cellulose diacetates, which under normal climate conditions degrade in one to two years only (M. Korn: "Nachwachsende und bioabbaubare Materialien im Verpackungsbereich" [Renewable and Biodegradable Materials in the Packaging Sector], first edition, 1993, publishing house Roman Kovar, Munich, page 122). EP-A-0 632 968 suggests the use of enzymes which split cellulose chains, and DE-A-43 22 966 suggests the use of the degradation-increasing additives urea and urea derivatives. Also EP-A-0 632 970 is based on the problem of accelerating the degradation rate of cellulose acetate filters, which is to be solved by adding nitrogen compounds. DE-A-43 25 352 suggests to use a cellulose acetate which is modified with ϵ-caprolactone for the preparation of filaments. EP-A-0 632 969 shows a degradable cellulose acetate with a low substituation coefficient (a cellulose acetate with a substituation coefficient of >2 is regarded as hardly degradable). EP-A-0 597 478 discloses a cellulose acetate with a substituation coefficient of <2.15 and degradation-accelerating additives such as polycaprolactone. EP-A-0 634 113 describes a tobacco filter and a method for its preparation on the basis of cellulose ester monofilaments by the use of up to 30% water-soluble polymers, e.g. starches, in order to improve the degradability of the filter tow. In order to improve the degradability of cigarette filters on the basis of cellulose acetate (fibers), EP-A-0 641 525 suggests the co-application of wood pulp. Also U.S. Pat. No. 5,396,909 describes a cigarette filter with a filter tow from cellulose acetate. WO 93/07771 describes a method for the preparation of a cigarette filter from cellulose-2,5-acetate, the degradation rate of which should be accelerated by the co-application of starch. EP-A-0 597 478 relates to a biodegradable cellulose acetate with a substitution coefficient of 1.0 to 2.15 for the use as a raw material for the preparation of i.a. cigarette filters. EP-A-0 539 191 shows a low-weight cigarette filter in which the filter material partly consists of a closed-pore foam. Thus, a reduction of the filter weight is achieved. An improved biodegradability is disclosed in DE-A-40 13 293 and DE-A-40 13 304 which is achieved by using the biopolymer polyhydroxy butyric acid and/or the copolymer polyhydroxy butyric acid/polyhydroxy valeric acid (PHB/PHV) as the fiber raw material for the preparation of a filter tow.

EP-A-0 614 620 describes a biodegradable filter element in the form of a foam or a film on the basis of starch. The filter material is prepared by extrusion. The extruder arrangement comprises a plurality of temperature zones.

GB-A-2 205 102 describes a method for preparing cigarette filters from an extruded polysaccharide material such as, e.g., starch, in the form of a film, foam or strand. Biodegradable starch fibers and their use in cigarette filters are also known from EP-A-0 541 050.

As can be seen by this variety of solutions, based on the increased environmental consciousness there is the need for an improved filter material, e.g. for cigarette filters, having good biodegradability properties.

SUMMARY AND OBJECTS OF THE INVENTION

It is the object of this invention to provide a filter tow or filter material from renewable raw materials for the preparation of cigarette filters or filters for smoker articles which has good filtering properties, does not influence the taste of the smoke or does not lead to a flavour loss and the biodegradability of which is improved.

This object is achieved with the features of the claims.

In achieving this object, the invention is based on the concept to provide a filter tow or filter material from fibers and filaments from biopolymers on the basis of thermoplastic starch and its polymer compositions.

In recent years, biopolymers from renewable agricultural raw materials have for many reasons been put in the center of public interest. Reasons therefor are for example the innovation in the development of materials from biopolymers, the preservation of fossil raw materials, the reduction of waste by a rapid complete biodegradability in the natural cycle, the climate protection by a reduction of the $CO_2$ emission, as well as the usability in agriculture. After being used, cigarette filters provided with the filter tow from biopolymers according to the present invention biodegrade rapidly due to natural degradation processes and provide an achievement, for example with respect to the prevention of cloggings and malfunctions in sewage treatment plants caused by smoked cigarette rests which are mainly flushed in via the public canal system. The used biopolymers which mainly consist of starch materials with thermoplastic properties, decompose in a short period of time into the basic products carbon dioxide and water when being exposed to the weather and the further influence of micro-organisms or reaching the sewage. Moreover, a great advantage is that such a tobacco smoke filter reduces the tar and condensate contents in the tobacco smoke without influencing the taste of the smoke.

BRIEF DESCRIPTION OF THE DRAWINGS

In the following, the invention will be described in connection with Examples and the respective drawings in which:

FIG. 1 is a method diagram of the preparation of filters from starch polymer fibers, FIG. 1*a* is a cross-sectional view of a filter element prepared according to FIG. 1, FIG. 1*b* is a longitudinal view of a filter element prepared according to FIG. 1, FIG. 1*c* is a longitudinal view of a cigarette with a filter prepared according to FIG. 1, FIG. 2*a* is a cross-sectional view of a filter element prepared according to FIG. 2, FIG. 2*b* is a longitudinal view of a filter element prepared according to FIG. 2, FIG. 2*c* is a longitudinal view of a cigarette with a filter prepared according to FIG. 2.

DETAILED DESCRIPTION OF THE PREFERRED EMBODIMENTS

Figure 2:
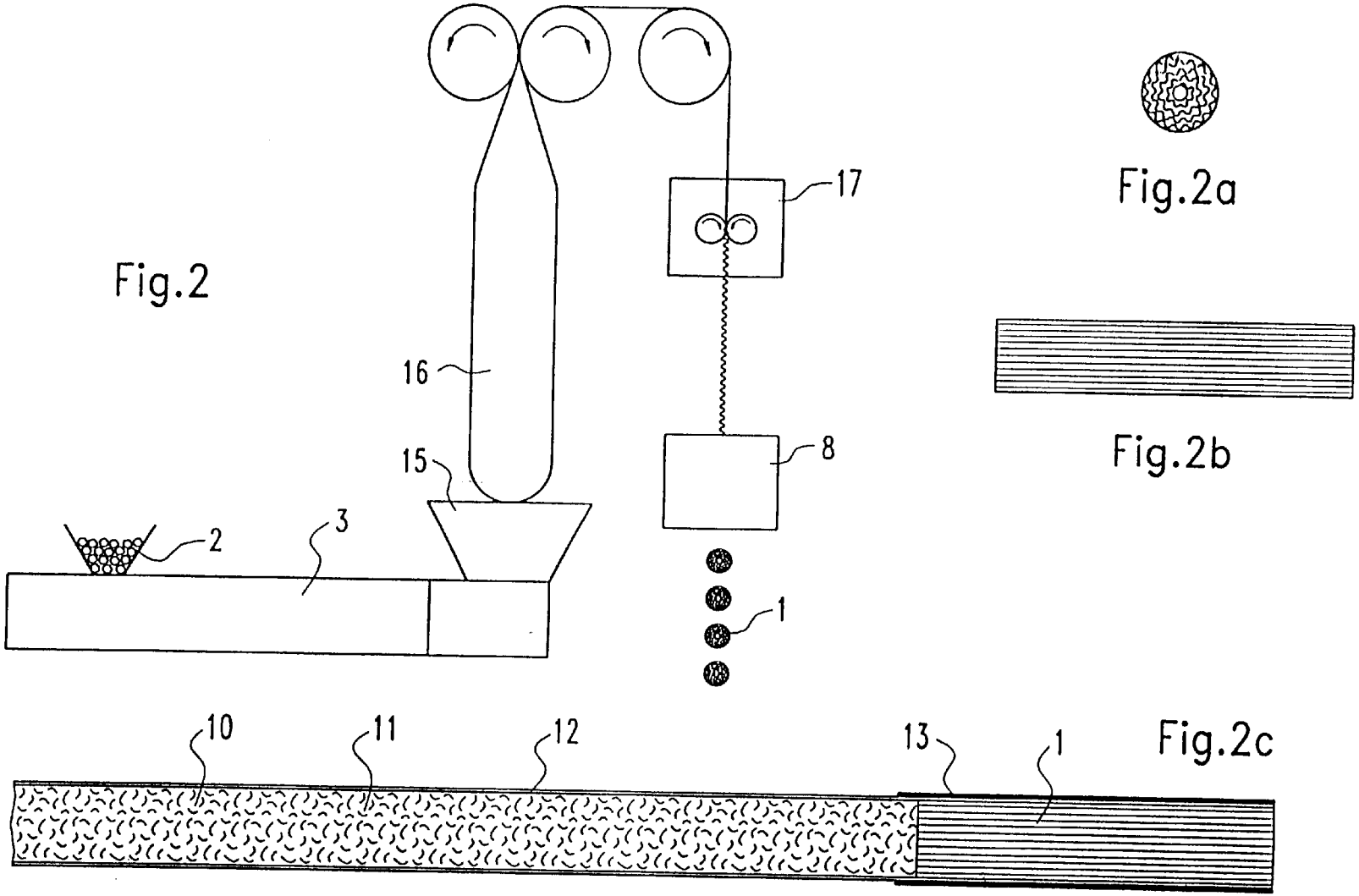
FIG. 2 is a method diagram of the preparation of filters from biopolymer films.

The starch materials used for the preparation of filter elements from the filter tow or filter material according to the present invention have thermoplastic properties which, after adaption of the operating conditions, allow a processing similar to that of synthetic polymers and/or cellulose acetates in the melt blown process or in the spinbonding process. In the melt blown process for the preparation of biopolymeric fibers from a melt spinning mass an extrusion arrangement is used, preferably with a melt pump and special melt blown dies (spinnerets) which are arranged in a row on a die rail with about 1000 dies. The extruded fibers on the basis of the starch polymer materials BIOPLAST® GF 102 and/or GF 105 are swirled by the air as endless fibers having a fiber diameter of 1 to 35 $\mu$m, cooled down and, if required, smoothed. Under air streams blowing in the axial direction which are heated in the beginning to 40 to 120° C. and influencing the fiber shape by variation with cold air, the fibers are combined in the following method steps to a fiber bundle or fiber strand, put on a rotating belt and pressed in a calender with partly heatable and partly coolable rolls to an endless filter or filter tow rod and are calibrated. Said fibers are not elongated very much and, therefore, have a soft and hairy structure and the great filter surface necessary for a filter tow.

In the spinbonding process the starch thermoplastic materials on the basis of the starch polymer materials BIOPLAST® GF 102 and/or GF 105 with a MFI (melting index according to DIN 53 735) value of 18–200 are processed to extremely fine fibers and a spin web in the extruder with a spin pump and a spinneret with a die plate and more than 1000 die orifices. From the single filaments a fiber curtain is prepared in which the cooling air supplied laterally at the die is accelerated such that the filaments are drawn. The extruded fibers fall 3 to 10 m into a fall stack and due to the falling depth at the low melting viscosity and due to the axial air stream the fibers are drawn (1:5 to 1:100); therefore, the strength of the fibers is increased considerably and the fiber diameter becomes 1 to 30 $\mu$m. At the bottom end of the stack air and fibers are swirled uniformly so that the formed filaments from the starch material are combined to an unsolidified band, crushed in a compression chamber crushing apparatus and processed to filter rods in a filter rod machine.

According to a preferred method shown in FIG. 1 for the preparation of the filter elements 1 according to the present invention, a starch polymer granulate 2 which is the basic material is processed to a melt in an extruder arrangement 3 by the addition of selected additives and, through a die plate with a respective number of orifices, extruded as a film in the form of single fibers 4. The fibers 4 pass through a rotating spin plate 5, are combined to a fiber bundle, then drawn through a guide 6, for example compression rolls, and formed to an endless filter 7. In a configuration arrangement 8 the final shaping takes place, wherein the endless filter 7 is optionally again supplied to a compression chamber crushing apparatus and processed to single filter elements 1 in a filter rod machine.

FIGS. 1*a* and 1*b* show a cross-sectional view and longitudinal view, respectively, of a filter element 1 from the fibers 4 of a starch polymer.

FIG. 1*c* shows a longitudinal view of a cigarette 10 with a filter element 12 prepared according to the present invention, wherein a portion containing tobacco 11 and a portion containing the filter element 1 are wrapped with cigarette paper 12 and connected with each other, and wherein the filter element 1 and the transition area to the portion containing tobacco 11 are wrapped with a further band 13 for strengthening purposes.

In the following, the biopolymers on the basis of renewable raw materials to be used according to the invention are described. They are suitable for the preparation of fibers, filaments, fiber filters and cotton wools, are mainly based on starch and comprise especially thermoplastic starch and the group of polymer compositions from thermoplastic starch, and further degradable polymer components such as polylactic acid, polyvinyl alcohol, polycaprolactone, aliphatic and aromatic polyesters and its copolymers. Further used additives are plasticizers such as glycerin and its derivatives, hexavalent sugar alcohols such as sorbit and its derivatives. The preparation of thermoplastic starch takes place in a first method step with the aid of a swelling agent or plasticizer without addition of water and by the use of dry or dried starch and/or starch which is dried by degasification during processing.

Standard starches contain as native starches 14% water, and as potato starches even 18% natural water content as the starting moisture. If a starch with more than 5% water content is plasticized or bonded under pressure and/or temperature, a destructed starch is formed which is prepared endothermally. The preparation method of the thermoplastic starch, however, is an exothermal process. Moreover, the thermoplastic starch contains less than 5% crystalline parts which remain unchanged. In the case of destructed starch the amount of crystalline parts is also small immediately after the preparation, it increases, however, upon storage of destructed starch. Subject to changes is also the glass transition point which remains at −40° C. for thermoplastic starch while, in comparison, it increases again to more than 0° C. for destructed starch (cf. also EP-A-0 397 819). For these reasons destructed starch and materials on the basis of destructed starch become relatively brittle when they are stored. For the preparation of the polymer compounds phase agents for the homogenization of the hydrophilic and polar starch polymer phase and the hydrophobic and unpolar polymer phase are used which are either supplied or preferably result in situ during the preparation of the polymer compound. Block copolymers are used as phase agents, which are described i.a. in WO 91/16375, EP-A-0 539 544, U.S. Pat. No. 5,280,055 and EP-A-0 596 437. The intermolecular compounding of said different polymers to processible granulates takes place under differentiated temperature and shearing conditions. Said thermoplastic blends are prepared technologically by coupling the phase interfaces between the rather intolerant polymers such that the distribution structure of the dispersed phase is achieved during processing through the optimum processing window (temperature and shearing conditions). The material properties of cellulose acetate fiber filters and other filters from low-molecular biopolymers such as polyhydroxy butyric acid (PHB) and polylactic acid (PLA) as well as filters with the filter material from starch polymer fibers according to the present invention differ from each other due to the different chemical structure of the polymer surfaces. The starches used as a macro molecule have a molecular weight of >1 million due to the amylopectin fraction dominating with more than 75%. Together with the hydrophilic polymer surface, this leads to improved adhesion properties of the harmful particles in the tobacco smoke to be filtered. Compared to the cellulose acetate filter, especially the condensate concentration in the inhalable tobacco smoke is reduced. Said effect is influenced by the amount of starch polymer fibrillars and the hydrophilicy of the fiber.

Suitable thermoplastic-starch-based polymer compounds and methods for their preparation are known e.g. from DE-A-43 17 696, WO 90/05161, DE-A-41 16 404, EP-A-0 542 155, DE-A-42 37 535 and DE-A-195 13 235 and were also suggested in PCT/EP 94/01946, DE-A-196 24 641, DE-A-195 13 237, DE-A-195 15 013, CH 1996-1965/96 and DE-A-44 46 054.

As shown in FIG. 2, according to a further method the filter tow or filter material for cigarettes and smoker articles according to the present invention is prepared from a film 16 from a starch material, by curling the film 16, folding it and, oriented in the longitudinal direction, preparing it as a round filter rod, and providing it with an external wrap consisting of paper and/or film material. The basic materials to be used according to the present invention correspond to the polymer materials described so far which are mainly based on starch. A filter tow from a curled and perforated film from cellulose acetate is disclosed in U.S. Pat. No. 5,396,909. According to the method schematically shown in FIG. 2, a starch polymer granulate 2 (starch material BIOPLAST® GF 102) is processed to a film 16 (BIOFLEX® BF 102) in an extruder arrangement 3 and a film blowing arrangement 15 connected thereto. The film 16 has the following properties:

It consists of 100% compostible mono film, corresponds to the quality requirements of DIN 54 900 of the test standard for biodegradable materials and has the "ok Compost" certification. The thickness of the film is 15–40 $\mu$m, the density 1.2 g/cm$^3$, the tensile strength in the longitudinal direction 20 N/mm$^2$, the tensile strength in the transverse direction 15 N/mm$^2$ and the water vapour permeability 600 g/24 h/m$^2$ ($^{at}$ 23° C. and 85% relative atmospheric moisture). A film having a "hard grip" and a film thickness of 30 $\mu$m is cut in strips, stretched, curled in a curling arrangement 17, folded, possibly perforated and finally processed to single filter elements 1 in a configuration apparatus 8. It is advantageous that the starch film 16 can take up much more water than synthetic polymer films such as polyethylene, polypropylene and cellulose acetate films. Thus, the condensate absorption can be controlled and the flexibility of the filter is increased. Filter tows or filter materials according to the present invention can also be prepared from biopolymer films, at least some of which contain thermoplastic starches. In this connection it is e.g. referred to DE-A-43 17 696, DE-A-42 28 016, WO 90/05161, DE-A-41 16 404, EP-A-0 542 155, DE-A-42 37 535, PCT/EP 94/01946, DE-A-44 46 054, DE-A-195 13 235, as well as to DE-A-195 13 237, DE-A-196 24 641, CH 1996-1965/96 and DE-A-195 15 013.

FIG. 2*a* shows an enlarged cross-sectional view and FIG. 2*b* an enlarged longitudinal view of a filter element 1 from a curled biopolymer film 16.

FIG. 2*c* shows a longitudinal view of a cigarette 10 with a filter element 1 prepared according to the method shown in FIG. 2. A portion containing tobacco 11 and a portion containing the filter element 1 of the cigarette 10 are wrapped with cigarette paper 12. Moreover, the filter element 1 is wrapped with a strengthening band 13 up to the transition area to the portion containing tobacco 11.

Figure 3:
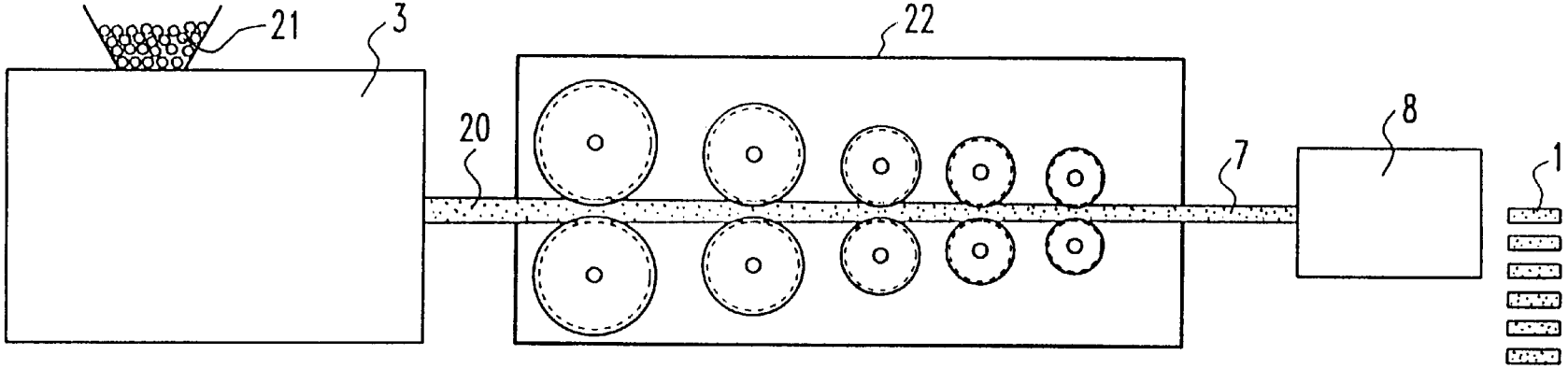
FIG. 3 is a method diagram of the preparation of filters from starch foam.

FIG. 3 shows a method diagram for the preparation of a filter tow or filter material according to the present invention for the use as a cigarette filter and filter for smoker articles from an extruded foam from renewable raw materials such as starch.

The preparation of starch foam by means of extrusion is basically known from e.g. DE-A-32 06 751 and DE-A-43 17 697. Since about 1930 the so-called boiling extrusion of starch has been known. In said method the starch is gelatinized under pressure and temperature preferably in a double shaft extruder, destructurized and extruded as a foam strand. Said technique is basically applied in the preparation of foamed snack products. Extruded starch foams are also known as packing chips. EP-A-0 447 792 discloses a method for the preparation by extrusion of paper foam from paper fibers, starch and completely saponified polyvinyl alcohol for the use as an insulating material.

According to the invention (FIG. 3) starch foam 20 from a basic mixture 21 of starch, preferably native potato starch, and plasticizing and film forming additives is compressed in an extrusion apparatus 3 by supplying thermal and mechanical energy, optionally modified, plasticized and expanded by a temperature and pressure drop, prepared as a foamed round profile having a diameter of 10 mm and rolled to a circle having a diameter of 7.8 mm and processed in a formatting process to filter rods having a length of 12.6 mm. The specific gravity of the foam filter elements is 12 kg/m$^3$. Extremely advantageous is that the extruded starch foam 29 is basically open-pored so that the foamed filter material from destructed starch having a crystalline content of less than 5% is able to absorb the liquids and liquid harmful particles such as condensate and tar products contained in the tobacco smoke, wherein the starch foam itself does not emit inhalable, volatile matters into the tobacco smoke.

Figure 3B:
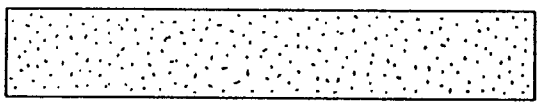
FIG. 3*b* is a longitudinal view of a filter element prepared according to FIG. 3.
Figure 3A:
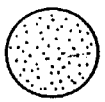
FIG. 3*a* is a cross-sectional view of a filter element prepared according to FIG. 3.

FIG. 3*a* shows an enlarged cross-sectional view and FIG. 3*b* an enlarged longitudinal view of a filter element 1 from starch foam 20.

Figure 3C:
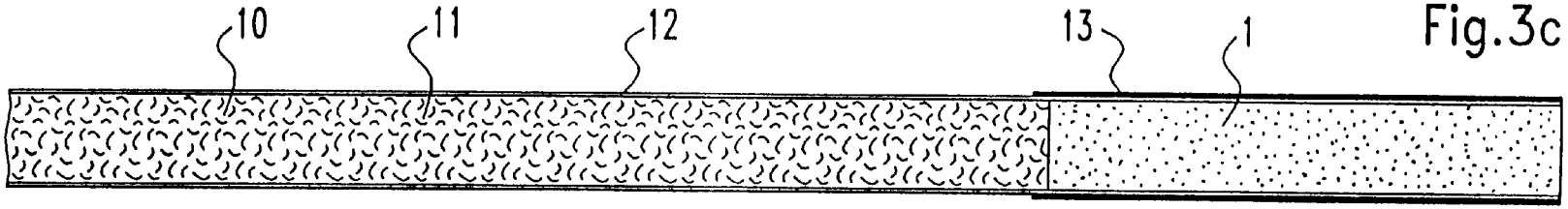
FIG. 3*c* is a longitudinal view of a cigarette with a filter prepared according to FIG. 3.

FIG. 3*c* shows a longitudinal view of a cigarette 10 with a filter element 1 prepared according to the method shown in FIG. 3. The portions containing the tobacco 11 and the filter element 1 of the cigarette 10 are wrapped with cigarette paper 12. Moreover, the filter element 1 is wrapped with an outer, strengthening band 13 up to the transition area to the portion containing tobacco 11.

In a single step method, as shown in FIG. 3, the starch foam 20 is prepared by extrusion with a double shaft extruder Continua 37® and compressed in a compression step, wherein it is processed in a calender apparatus 22 to an endless filter 7. The final shaping and separation to filter elements 1 takes place in a configuration apparatus 8. The method conditions and recipes for the single step method organization of the preparation of the filter tow or filter material from starch foam are shown in Tables I and Ia by means of 4 examples each. In this connection, a mainly elastic and compressible filter tow with an open-pore foam structure leads to a satisfying method result (Examples 1 to 3 and 5 to 8). In the method according to Examples 1 to 8 (Tables I and Ia) and FIG. 3 a double shaft extruder model Continua C 37 of the company Werner & Pfleiderer is used for the extrusion of the starch foam material. Said extruder has a die plate which can be provided with 1 to 4 die orifices having a diameter of 1.5 to 4 mm each. External cooling-heating devices control the temperature of the extruder arrangement. The extruder arrangement has six temperature zones, wherein the first four zones are kept at temperatures between 25 and 140° C. The temperature zones 5 and 6 can have temperatures between 140 and 165° C. The preferred temperature adjustments can be taken from Tables I and Ia:

TABLE I

| Example | | No. 1 | No. 2 | No. 3 | No. 4 |
|---|---|---|---|---|---|
| Double shaft extruder | | | | | |
| Extruder data | Model | Continua C 37 | Continua C 37 | Continua C 37 | Continua C 37 |
| | temp. zone 1 | 40° C. | 40° C. | 40° C. | 40° C. |
| | temp. zone 2 | 70° C. | 70° C. | 70° C. | 70° C. |
| | temp. zone 3 | 150° C. | 150° C. | 150° C. | 150° C. |
| | temp. zone 4 | 170° C. | 170° C. | 170° C. | 165° C. |
| | temp. zone 5 | 185° C. | 185° C. | 185° C. | 180° C. |
| | temp. zone 6 | 200° C. | 200° C. | 200° C. | 195° C. |
| | rpm | 350 | 350 | 350 | 350 |
| | torque % | 70 | 70 | 63 | 63 |
| | temp. of melt | 195° C. | 180° C. | 190° C. | 190° C. |
| | pressure of melt | 50 bars | 40 bars | 30 bars | 30 bars |
| | die diameter | 2.5 mm | 4.0 mm | 4.0 mm | 4.0 mm |
| | number of dies | 1 | 1 | 1 | 1 |
| | arrangement of dies | centrally | centrally | centrally | centrally |
| Dosage | liquid dosage, water | 5/55 | 5/35 | 5/10 | 5/10 |
| | solid matter dosage | 16.0 kg/h | 20.0 kg/h | 23.0 kg/h | 16.0 kg/h |
| Recipes | potato starch | 74.906% | 74.906% | 74.906% | 96.618% |
| | blowing agent | 2.247% | 2.247% | 2.247% | 2.877% |
| | PVOH | 22.472% | 22.472% | 22.472% | 0.000% |
| | flow auxiliary | 0.375% | 0.375% | 0.375% | 0.483% |
| Calender | pressure pair 1 of calender rolls | 10 N/cm$^2$ | 10 N/cm$^2$ | 10 N/cm$^2$ | 10 N/cm$^2$ |
| | pressure pair 2 of calender rolls | 30 N/cm$^2$ | 30 N/cm$^2$ | 30 N/cm$^2$ | 30 N/cm$^2$ |
| | pressure pair 3 of calender rolls | 50 N/cm$^2$ | 50 N/cm$^2$ | 50 N/cm$^2$ | 50 N/cm$^2$ |
| | pressure pair 4 of calender rolls | 70 N/cm$^2$ | 70 N/cm$^2$ | 70 N/cm$^2$ | 70 N/cm$^2$ |
| System data | diameter endless filter | 0.95 cm | 0.85 cm | 0.80 cm | 0.83 cm |
| | diameter filter compressed | 0.78 cm | 0.78 cm | 0.78 cm | not measurable |
| | density endless filter | 10.0 kg/m$^3$ | 12.6 kg/m$^3$ | 11.4 kg/m$^3$ | 16.0 kg/m$^3$ |
| | density filter compressed | 13.3 kg/m$^3$ | 14.9 kg/m$^3$ | 11.9 kg/m$^3$ | not measurable |
| Remarks | | elastic flexible compressible open-pore foam | elastic flexible compressible open-pore foam | elastic flexible compressible open-pore foam | very strong brittle not compressible coarse structure |

TABLE Ia

| Example | | No. 5 | No. 6 | No. 7 | No. 8 |
|---|---|---|---|---|---|
| Double shaft extruder | | | | | |
| Extruder data | Model | Continua C 37 | Continua C 37 | Continua C 37 | Continua C 37 |
| | temp. zone 1 | 40° C. | 40° C. | 40° C. | 40° C. |
| | temp. zone 2 | 70° C. | 70° C. | 70° C. | 70° C. |
| | temp. zone 3 | 150° C. | 150° C. | 150° C. | 150° C. |
| | temp. zone 4 | 170° C. | 170° C. | 170° C. | 165° C. |
| | temp. zone 5 | 185° C. | 185° C. | 185° C. | 180° C. |
| | temp. zone 6 | 200° C. | 200° C. | 200° C. | 195° C. |
| | rpm | 350 | 350 | 350 | 350 |
| | torque % | 85 | 90 | 70 | 70 |
| | temp. of melt | 195° C. | 180° C. | 190° C. | 190° C. |
| | pressure of melt | 50 bars | 40 bars | 30 bars | 15 bars |
| | die diameter | 2.5 mm | 4.0 mm | 4.0 mm | 4.0 mm |

TABLE Ia-continued

| Example | | No. 5 | No. 6 | No. 7 | No. 8 |
|---|---|---|---|---|---|
| | number of dies | 1 | 1 | 1 | 1 |
| | arrangement of dies | centrally | centrally | centrally | centrally |
| Dosage | liquid dosage, water | 5/55 | 5/35 | 5/10 | 5/10 |
| | solid matter dosage | 16.0 kg/h | 20.0 kg/h | 23.0 kg/h | 16.0 kg/h |
| Recipes | potato starch | 74.906% | 74.906% | 74.906% | 74.906% |
| | blowing agent | 2.247% | 2.247% | 2.247% | 2.247% |
| | polyester amide* | 22.472% | 22.472% | 0.000% | 0.000% |
| | polyester urethane** | 0.000% | 0.000% | 22.472% | 22.472% |
| | flow auxiliary | 0.375% | 0.375% | 0.375% | 0.375% |
| Calender | pressure pair 1 of calender rolls | 10 $N/cm^2$ | 10 $N/cm^2$ | 10 $N/cm^2$ | 10 $N/cm^2$ |
| | pressure pair 2 of calender rolls | 30 $N/cm^2$ | 30 $N/cm^2$ | 30 $N/cm^2$ | 30 $N/cm^2$ |
| | pressure pair 3 of calender rolls | 50 $N/cm^2$ | 50 $N/cm^2$ | 50 $N/cm^2$ | 50 $N/cm^2$ |
| | pressure pair 4 of calender rolls | 70 $N/cm^2$ | 70 $N/cm^2$ | 70 $N/cm^2$ | 70 $N/cm^2$ |
| System data | diameter endless filter | 0.95 cm | 0.85 cm | 0.78 cm | 0.78 cm |
| | diameter filter compressed | 0.78 cm | 0.78 cm | 0.78 cm | 0.78 |
| | density endless filter | 12.0 $kg/m^3$ | 14.0 $kg/m^3$ | 11.0 $kg/m^3$ | 16.0 $kg/m^3$ |
| | density filter compressed | 15.0 $kg/m^3$ | 16.0 $kg/m^3$ | 11.0 $kg/m^3$ | 16.0 $kg/m^3$ |
| Remarks | | elastic flexible compressible | elastic flexible compressible | very elastic very flexible not compressible | very elastic very flexible not compressible |
| | | open-pore foam | open-pore foam | open-pore foam | open-pore foam |

*Polyester amide Bayer AG BAK 1095, EP-A-0 641 817
**Polyester urethane Bayer AG Degranil DLN, DE-A-196 51 151

The speeds of the double shaft extruder are preferably between 200 and 300 rpm. Together with the dosage amount of the basic material, the speed essentially determines the torque of the extruder arrangement. For the tests a speed of 350 rpm was selected. An optimum expansion of the starch foam 20 is achieved at mass temperatures of the melt between 160 to 195° C. Said mass temperatures were realized during the tests. In the extruder arrangement operating pressures between 25 to 55 bars arise, wherein the best results are achieved with high mass pressures. With respect to the die configuration, variations of the diameter, the number of dies and the arrangement of the die orifices in the die plate were tested. The die orifices were tested with a diameter of 1.5 to 3 mm, wherein the number of dies varied between 1 and 3 dies. The arrangement of the die orifices was tested from the center of the die plate to a medium diameter and to the greatest diameter. From the tests of the single step method one die having an opening diameter of 2.5 mm (Example 1) and one die having an opening diameter of 4 mm (examples 2 to 4), which were placed centrally, were tested.

The basic materials for the preparation method of the filter tow or filter material according to the present invention are: native potato starch of the company Emsland, type. Superior blowing agent ($NaHCO_3$—$CaCO_3$ citric acid compound), polyvinyl alcohol of the company Hoechst, type Mowiol 17-88 and flow auxiliary (tricalciumphosphate), as well as possibly polyester amide (obtainable from the company Bayer AG under the name VP BAK 1095) as known from EP-A-0 641 817 and polyester urethane (obtainable from the company Bayer AG under the name Degranil DLN) as suggested in DE-A-196 15 151.

A single-shaft volumetric dosing apparatus is used for dosing the starch additive mixture (solid matter dosage), wherein the dosage amounts directly depend on the operating parameters of the extruder arrangement. The apparatus uses a hollow shaft and has an operative range of 1.5 kg/h to 35 kg/h. The preferred dosage amounts can be taken from FIG. 4.

A membrane dosing apparatus model Gamma/5 of the company ProMint is used for liquid dosage. In Examples 1 to 8 the liquid dosage amount was varied from 0 to 5 liters/hour. In Table I the dosed volumes of the liquid are indicated as the stroke amount adjustment (in 0.1 ml/stroke) per stroke frequency adjustment (in strokes per minute) of the dosage pump. When the dosing apparatus is adjusted at 5:55, 0.5 ml per stroke are added in 55 strokes per minute. This results is a dosage amount of 27.5 ml per minute.

The calender arrangement 22 consists of four milled pulleys arranged in tandem. The diameter of the pulleys and the groove depth/groove width were varied in the tests. Furthermore, the application of tension springs with different tension strengths were tested, which can create a pressure acting against the pulleys of 5 to 100 N. The preferred pressures of the calender arrangement can be taken from Table I. The endless filter 7 from the starch foam 20 was thus decreased to varying sizes and then brought to a standardized final diameter.

During a subsequent conditioning the starch foam 20 is optionally adjusted to a particular residual water content.

A pelletizer with an incorporated draw-in roller is used as the configuration arrangement 8. At a constant draw-in rate the length of the filter elements 1 or the cigarette filter can be adjusted by the adjustment of the cutter speed and the number of cutters.

Based on the Examples carried out, the following findings were made:

When the screw speed of the extruder arrangement is increased, the mass pressure and the melting temperature increase and the expansion of the starch foam improves. At the same time the dosage amount has to be increased in order to maintain this effect. If a great amount of liquid is added, the starch foam expands very much directly behind the die and then collapses. Therefore, the dosage amount ratio of the solid matters and the liquid must be exactly adjusted. The adjustable operating parameters are limited by the maximum torque of the extruder arrangement 3 so that the transferred amount and the temperature control during the processing of the basic materials in the extruder are in the medium range. Depending on the adjusted operating parameters of the extruder and dosage arrangements, before passing through the calender arrangement 22 the endless filter 7 from starch foam 20 has a density between 6 kg/m$^3$ to 10 kg/m$^3$. After compression in the calender arrangement 22, the density of the endless filter 7 increases since the volume is decreased at a constant mass. Said density increase essentially depends on the diameter of the endless filter 7 upstream of the calender arrangement 22, the number of pulleys and the pressures.

In a two-step method, first the starch granulate is prepared according to a known method (e.g. DE-A-43 17 696 or WO 90/05161). Then the starch granulate is processed in a further extrusion process in a single shaft extruder to a starch foam strand and fabricated to a filter tow or filter element 1 under conditions similar to those of the single step process. A detailed description of this method is therefore not necessary. Based on four examples each, Tables II and IIa show method conditions and recipes for the preparation of a thermoplastic starch polymer granulate (first method step).

Tables III and IIIa show the method conditions for the preparation of filter tows or filter material from a thermoplastic starch polymer granulate which is processed to starch foam (second method step).

TABLE II

| Example | | No. 1 | No. 2 | No. 3 | No. 4 |
|---|---|---|---|---|---|
| Double shaft extruder | | | | | |
| Extruder data | Model | Continua C 37 | Continua C 37 | Continua C 37 | Continua C 37 |
| | temp. zone 1 | 40° C. | 40° C. | 40° C. | 40° C. |
| | temp. zone 2 | 70° C. | 70° C. | 70° C. | 70° C. |
| | temp. zone 3 | 120° C. | 120° C. | 120° C. | 120° C. |
| | temp. zone 4 | 120° C. | 120° C. | 120° C. | 120° C. |
| | temp. zone 5 | 120° C. | 120° C. | 120° C. | 120° C. |
| | temp. zone 6 | 120° C. | 120° C. | 120° C. | 120° C. |
| | rpm | 350 | 350 | 350 | 350 |
| | torque % | 70 | 70 | 70 | 70 |
| | temp. of melt | 125° C. | 125° C. | 125° C. | 125° C. |
| | pressure of melt | 50 bars | 40 bars | 30 bars | 30 bars |
| | die diameter | 1.5 mm | 1.5 mm | 1.5 mm | 1.5 mm |
| | number of dies | 2 | 2 | 2 | 2 |
| | arrangement of dies | parallel | parallel | parallel | parallel |
| Dosage | liquid dosage, water | 25/55 | 25/55 | 25/55 | 25/55 |
| | solid matter dosage | 23.0 kg/h | 23.0 kg/h | 23.0 kg/h | 23.0 kg/h |
| Recipes | potato starch | 74.906% | 74.906% | 74.906% | 96.618% |
| | sponging agent | 2.247% | 2.247% | 2.247% | 2.877% |
| | PVOH | 22.472% | 22.472% | 22.472% | 0.000% |
| | flow auxiliary | 0.375% | 0.375% | 0.375% | 0.483% |
| System data | granulate diameter | 0.20 cm | 0.20 cm | 0.20 cm | 0.20 cm |
| Remarks | | On a single shaft extruder the thermoplastic starch polymer granulates are processed to the filter tow from BIOPUR starch foam according to the present invention/Table III | | | |

TABLE IIa

| Example | | No. 5 | No. 6 | No. 7 | No. 8 |
|---|---|---|---|---|---|
| Double shaft extruder | | | | | |
| Extruder data | Model | Continua C 37 | Continua C 37 | Continua C 37 | Continua C 37 |
| | temp. zone 1 | 40° C. | 40° C. | 40° C. | 40° C. |
| | temp. zone 2 | 70° C. | 70° C. | 70° C. | 70° C. |
| | temp. zone 3 | 150° C. | 150° C. | 150° C. | 150° C. |
| | temp. zone 4 | 170° C. | 170° C. | 170° C. | 170° C. |
| | temp. zone 5 | 185° C. | 185° C. | 185° C. | 185° C. |
| | temp. zone 6 | 200° C. | 200° C. | 200° C. | 200° C. |
| | rpm | 350 | 350 | 350 | 350 |
| | torque % | 86 | 70 | 78 | 70 |
| | temp. of melt | 205° C. | 205° C. | 205° C. | 205° C. |
| | pressure of melt | 50 bars | 40 bars | 40 bars | 30 bars |
| | die diameter | 1.5 mm | 1.5 mm | 1.5 mm | 1.5 mm |
| | number of dies | 2 | 2 | 2 | 2 |
| | arrangement of dies | parallel | parallel | parallel | parallel |
| Dosage | liquid dosage, water | 25/55 | 15/55 | 25/55 | 15/55 |
| | solid matter dosage | 23.0 kg/h | 18.0 kg/h | 23.0 kg/h | 18.0 kg/h |
| Recipes | potato starch | 74.906% | 74.906% | 74.906% | 96.618% |
| | polyester amide* | 22.472% | 22.472% | 0.000% | 0.000% |
| | polyester urethane** | 0.000% | 0.000% | 22.472% | 22.472% |
| | flow auxiliary | 0.375% | 0.375% | 0.375% | 0.375% |
| System data | granulate diameter | 0.20 cm | 0.20 cm | 0.20 cm | 0.20 cm |
| Remarks | | On a single shaft extruder the thermoplastic starch polymer granulates are processed to the filter tow from BIOPUR starch foam according to the present invention/Table III | | | |

*Polyester amide Bayer AG BAK1095, EP-A-0641 817

**Polyester urethane Bayer AG Degranil DLN, DE-A-196 51 151

TABLE III

| Example | | No. 1 | No. 2 | No. 3 | No. 4 |
|---|---|---|---|---|---|
| Single shaft extruder | | | | | |
| Extruder data | screw diameter | 50 mm | 50 mm | 50 mm | 50 mm |
| | screw length | 135 cm | 135 cm | 135 cm | 135 cm |
| | residence time | 45 sec | 45 sec | 45 sec | 45 sec |
| | temp. zone 1 | 40° C. | 40° C. | 40° C. | 40° C. |
| | temp. zone 2 | 70° C. | 70° C. | 70° C. | 70° C. |
| | temp. zone 3 | 190° C. | 190° C. | 190° C. | 190° C. |
| | temp. zone 4 | 190° C. | 190° C. | 190° C. | 190° C. |
| | temp. zone 5 | 190° C. | 190° C. | 190° C. | 190° C. |
| | temp. zone 6 | 195° C. | 190° C. | 185° C. | 190° C. |
| | rpm | 350 | 350 | 350 | 350 |
| | current consumption | 25 Ampere | 26 Ampere | 27 Ampere | 26 Ampere |
| | temp. of melt | 197° C. | 192° C. | 187° C. | 190° C. |
| | pressure of melt | 50 bars | 50 bars | 50 bars | 30 bars |
| | die diameter | 1.5 mm | 1.5 mm | 1.5 mm | 1.5 mm |
| | number of dies | 2 | 2 | 2 | 2 |
| | arrangement of dies | parallel | parallel | parallel | parallel |
| Dosage | solid matter dosage | 48.0 kg/h | 48.0 kg/h | 48.0 kg/h | 48.0 kg/h |
| Recipes | cf. Table II | No. 1 | No. 2 | No. 3 | No. 4 |
| Calender | pressure pair 1 of calender rolls | 10 N/cm$^2$ | 10 N/cm$^2$ | 10 N/cm$^2$ | 10 N/cm$^2$ |
| | pressure pair 2 of calender rolls | 30 N/cm$^2$ | 30 N/cm$^2$ | 30 N/cm$^2$ | 30 N/cm$^2$ |
| | pressure pair 3 of calender rolls | 50 N/cm$^2$ | 50 N/cm$^2$ | 50 N/cm$^2$ | 50 N/cm$^2$ |
| | pressure pair 4 of calender rolls | 70 N/cm$^2$ | 70 N/cm$^2$ | 70 N/cm$^2$ | 70 N/cm$^2$ |
| System data | diameter endless filter | 0.97 cm | 0.85 cm | 0.83 cm | 0.85 cm |
| | diameter filter compressed | 0.78 cm | 0.78 cm | 0.78 cm | not measurable |
| | density endless filter | 10.2 kg/m$^3$ | 10.1 kg/m$^3$ | 9.5 kg/m$^3$ | 16.0 kg/m$^3$ |
| | density filter compressed | 15.7 kg/m$^3$ | 13.1 kg/m$^3$ | 10.7 kg/m$^3$ | |
| Remarks | | elastic flexible compressible | elastic flexible compressible | elastic flexible compressible | very strong brittle not compressible |
| | | open-pore foam | open-pore foam | open-pore foam | coarse structure |

TABLE IIIa

| Example | | No. 5 | No. 6 | No. 7 | No. 8 |
|---|---|---|---|---|---|
| Single shaft extruder | | | | | |
| Extruder data | screw diameter | 50 mm | 50 mm | 50 mm | 50 mm |
| | screw length | 135 cm | 135 cm | 135 cm | 135 cm |
| | residence time | 45 sec | 45 sec | 45 sec | 45 sec |
| | temp. zone 1 | 40° C. | 40° C. | 40° C. | 40° C. |
| | temp. zone 2 | 70° C. | 70° C. | 70° C. | 70° C. |
| | temp. zone 3 | 190° C. | 190° C. | 190° C. | 190° C. |
| | temp. zone 4 | 190° C. | 190° C. | 190° C. | 190° C. |
| | temp. zone 5 | 190° C. | 190° C. | 190° C. | 190° C. |
| | temp. zone 6 | 195° C. | 190° C. | 185° C. | 190° C. |
| | rpm | 350 | 350 | 350 | 350 |
| | current consumption | 25 Ampere | 26 Ampere | 27 Ampere | 26 Ampere |
| | temp. of melt | 208° C. | 208° C. | 205° C. | 208° C. |
| | pressure of melt | 280 bars | 280 bars | 260 bars | 260 bars |
| | die diameter | 1.5 mm | 1.5 mm | 1.5 mm | 1.5 mm |
| | number of dies | 2 | 2 | 2 | 2 |
| | arrangement of dies | parallel | parallel | parallel | parallel |
| Dosage | solid matter dosage | 48.0 kg/h | 48.0 kg/h | 48.0 kg/h | 48.0 kg/h |
| Recipes | cf. Table IIa | No. 5 | No. 6 | No. 7 | No. 8 |
| Calender | pressure pair 1 of calender rolls | 10 N/cm$^2$ | 10 N/cm$^2$ | 10 N/cm$^2$ | 10 N/cm$^2$ |
| | pressure pair 2 of calender rolls | 30 N/cm$^2$ | 30 N/cm$^2$ | 30 N/cm$^2$ | 30 N/cm$^2$ |
| | pressure pair 3 of calender rolls | 50 N/cm$^2$ | 50 N/cm$^2$ | 50 N/cm$^2$ | 50 N/cm$^2$ |
| | pressure pair 4 of calender rolls | 70 N/cm$^2$ | 70 N/cm$^2$ | 70 N/cm$^2$ | 70 N/cm$^2$ |
| System data | diameter endless filter | 0.97 cm | 0.90 cm | 0.78 cm | 0.78 cm |
| | diameter filter compressed | 0.78 cm | 0.78 cm | 0.78 cm | 0.78 cm |
| | density endless filter | 9.5 kg/m$^3$ | 9.5 kg/m$^3$ | 9.5 kg/m$^3$ | 9.0 kg/m$^3$ |
| | density filter compressed | 12.0 kg/m$^3$ | 11.0 kg/m$^3$ | 9.5 kg/m$^3$ | 9.0 kg/m$^3$ |
| Remarks | | elastic flexible compressible | elastic flexible compressible | very elastic very flexible not compressible | very elastic very flexible not compressible |
| | | open-pore foam | open-pore foam | open-pore foam | open-pore foam |

Figure 4:
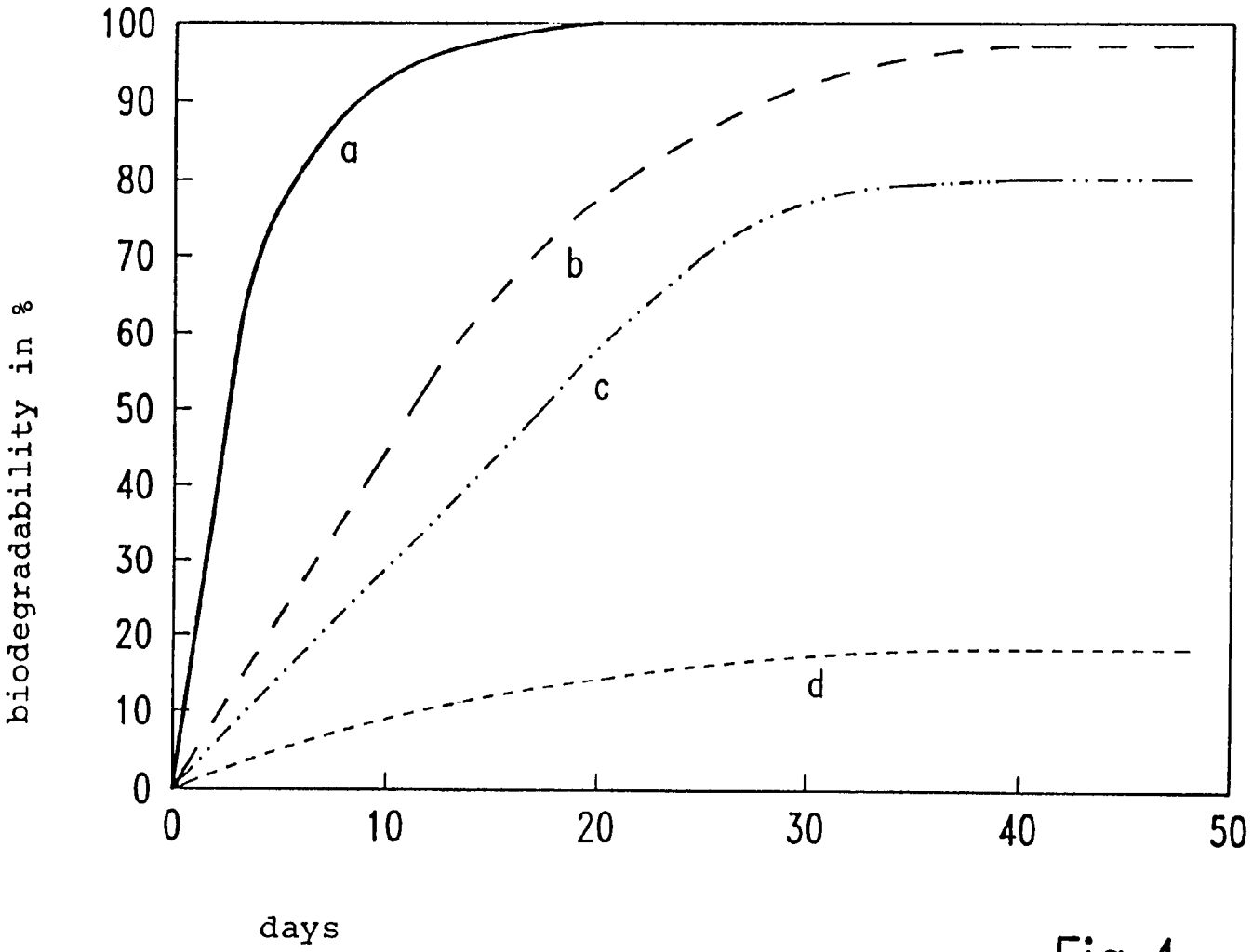
FIG. 4 is a graphical view of the biodegradability of different filter materials.

FIG. 4 graphically shows results of biodegradation tests for the filter material according to the present invention, wherein line a) represents starch foam, line b) fibers and films (starch material BIOFLEX® BF 102), line c) cellulose powder and line d) cellulose-2,5-acetate. The essential property of the filter material according to the present invention is the rapid biodegradation. Said property was tested (at the institute O.W.S. in Gent, Belgium) with the starch polymer material BIOFLEX® BF 102 according to the following method: CEN Draft "Evaluation of the Ultimate Aerobic Biodegradability and Disintegration of Packing Materials under Controlled Composting Conditions—Method by Analysis of Released Carbon Dioxide" according to modified ASTM D 5338-92. Under the test conditions, 96.6% of the starch material BIOFLEX® BF 102 of which the fibers and films for the preparation of the filter tow or filter material according to the present invention consist, were mineralized after 45 days. Only 79.6% of the reference substance, pure cellulose powder (line c)) which is regarded as completely biodegradable, degraded in the same time under the same conditions. According to an opinion of the institute O.W.S., BIOFLEX® BF 102 can therefore be regarded as completely biodegradable. Due to its porous surface and polymer composition, the filter material from starch foam (line d)) completely biodegrades more rapidly. The excellent biodegradability was determined by the CSB (chemical oxygen requirement in mg/l) and the $BSB_5$ (biological oxygen requirement in mg/l), wherein a CSB of 1050 mg/l and a $BSB_5$ of 700 mg/l were measured. The quotient from $BSB_5/CSB \times 100$ gives the very high biodegradability of 66%, wherein values of more than 50% are regarded as a very good biodegradability. After 10 days only, more than 90% of the filter material from starch foam biodegraded under aerobic composing conditions. All filter materials according to the present invention correspond to the quality requirements of the LAGA Information Sheet M 10: Quality criteria and application recommendations for compost and DIN 54 900: "Testing the compostibility of polymer materials" and the "ok Compost" certification.

We claim:

1. A method for manufacturing biodegradable filter elements comprising:

(a) continuously supplying a mixture to an extruder, the mixture consisting essentially of a starch-based polymer selected from the group consisting of native starches, modified starches, and thermoplastic starch polymers, at least one synthetic polymer selected from the group consisting of polyvinyl alcohol, polyester amides, polyester urethanes, aliphatic polyesters, aromatic polyesters, and copolymers of aliphatic polyesters and aromatic polyesters, optionally a flow auxiliary, and optionally a blowing agent, wherein the starch-based polymer supplied to the extruder comprises starch that has been initially predried to below its natural water content;

(b) heating and kneading the mixture under conditions so as to form a thermoplastic melt;

(c) extruding the thermoplastic melt through a die to form an extrudate of the thermoplastic melt;

(d) causing the extrudate to develop a porous configuration;

(e) compressing the extrudate and forming an endless filter rod; and (f) wrapping the filter rod and forming single filter elements.

2. A method according to claim 1, wherein steps (c) and (d) are part of a single continuous process.

3. A method according to claim 1, wherein steps (a) through (c) yield a thermoplastic starch polymer granulate which is subsequently processed in a single-shaft extruder to yield the filter elements according to steps (a) through (f).

4. A method according to claim 1, wherein steps (a) through (c) are performed using a double shaft extruder.

5. A method according to claim 1, wherein the extrudate formed in step (c) is in a form selected from the group consisting of filaments, a film, and a foam.

6. A method according to claim 1, wherein the die utilized in step (c) has a die configuration selected from the group consisting of a die having more than 100 die orifices for the extrusion of filaments, a die having from 1 to 2 die orifices for the extrusion of films, and a die having from 1 to 40 die orifices for the extrusion of foams.

7. A method according to claim 1, wherein the die is configured for the extrusion of films, is selected from the group consisting of a film die, a tubular die, and a double tubular die, and yields a film selected from the group consisting of a flat film and a brown film.

8. A method according to claim 1, wherein the extruder includes a plurality of temperature zones.

9. A method according to claim 8, wherein step (a) is carried out in first and second temperature zones and wherein step (b) is carried out in third to sixth temperature zones.

10. A method according to claim 8, wherein the extruder includes six temperature zones having approximately the following temperature profiles:

Zone 1: 25–45° C.

Zone 2: 70–110° C.

Zone 3: 110–160° C.

Zone 4: 150–220° C.

Zone 5: 180–220° C.

Zone 6: 180–220° C.

wherein the thermoplastic melt is extruded at a temperature of approximately 180–220° C. as a foam.

11. A method according to claim 8, wherein the extruder includes six temperature zones having approximately the following temperature profiles:

Zone 1: 25–45° C.

Zone 2: 60–100° C.

Zone 3: 90–120° C.

Zone 4: 90–120° C.

Zone 5: 90–120° C.

Zone 6: 90–125° C.

wherein the thermoplastic melt is extruded at a temperature of approximately 80–180° C. as a granulate.

12. A method according to claim 8, wherein the extruder includes six temperature zones having approximately the following temperature profiles:

Zone 1: 25–45° C.

Zone 2: 60–120° C.

Zone 3: 100–190° C.

Zone 4: 140–190° C.

Zone 5: 140–190° C.

Zone 6: 140–200° C.

wherein the thermoplastic melt is extruded at a temperature of approximately 150–200° C. as a foam.

13. A method according to claim 1, wherein the thermoplastic melt is plasticized prior to being extruded.

14. A method according to claim 1, wherein the filter material is compressed to a strand transversely to its axis and wrapped.

15. A method according to claim 1, wherein the starch-based polymer supplied to the extruder is dried by degasification during processing.

16. A method for manufacturing biodegradable filter elements comprising:

(a) forming a thermoplastic starch/polymer melt comprising a blend of thermoplastic starch and at least one synthetic polymer, wherein the thermoplastic starch is formed by mixing starch and at least one plasticizer under conditions that result in the thermoplastic starch having a water content of less than 5%, wherein the synthetic polymer is selected from the group consisting of polyvinyl alcohol, polyester amides, polyester urethanes, aliphatic polyesters, aromatic polymers, and copolymers of aliphatic polyesters and aromatic polyesters;

(b) extruding the thermoplastic starch/polymer melt to form an extrudate; and (c) processing the extrudate into a filter element.

17. A method according to claim 16, wherein the filter element is free of cellulose esters.

18. A method for manufacturing biodegradable filter elements comprising:

(a) continuously supplying a mixture to an extruder, the mixture consisting essentially of one or more renewable raw materials, at least one hydrophobic synthetic polymer selected from the group consisting of polyester urethanes, aliphatic polyesters, aromatic polyesters, and copolymers of aliphatic polyesters and aromatic polyesters, optionally a flow auxiliary, and optionally a blowing agent;

(b) heating and kneading the mixture under conditions so as to form a thermoplastic melt;

(c) extruding the thermoplastic melt to form an extrudate; and (d) processing the extrudate into a filter element.

19. A method according to claim 18, wherein the renewable raw material consists essentially of a starch-based polymer selected from the group consisting of native starches, modified starches and thermoplastic starch polymers.

* * * * *

UNITED STATES PATENT AND TRADEMARK OFFICE

CERTIFICATE OF CORRECTION

PATENT NO. : 6,062,228
DATED : May 16, 2000
INVENTOR(S) : Juergen Loercks; Harald Schmidt It is certified that error appears in the above-identified patent and that said Letters Patent is hereby corrected as shown below:

Column 1,
Line 8, please change "pines." to -- pipes -- and a method for preparing it. --
Line 17, before "paper" insert -- either --
Line 18, after "known" delete -- either --
Line 32, after "explained" delete -- i.a. --

Column 2,
Line 38, after "loss" please insert a comma
Line 47, please change "Reasons therefore are for example the" to -- Reasons include, for example, the --
Line 51, after "cycle" insert -- and --

Column 4,
Line 31, please change "element 12" to -- element --
Line 49, before "hexavalent" insert -- and --

Column 5,
Line 11, after "described" delete -- i.a. --
Line 66, please change "g/24 h/m$^2$ (at 23°C" to -- g/24 h/m$^2$ (at 23°C --

UNITED STATES PATENT AND TRADEMARK OFFICE

CERTIFICATE OF CORRECTION

PATENT NO. : 6,062,228
DATED : May 16, 2000
INVENTOR(S) : Juergen Loercks; Harald Schmidt It is certified that error appears in the above-identified patent and that said Letters Patent is hereby corrected as shown below:

Column 6,
Line 17, after "2b" insert -- shows --

Signed and Sealed this

Fourteenth Day of August, 2001

*Attest:*

Nicholas P. Godici

*Attesting Officer*

NICHOLAS P. GODICI
*Acting Director of the United States Patent and Trademark Office*